US006343969B1

(12) United States Patent
Spector

(10) Patent No.: US 6,343,969 B1
(45) Date of Patent: Feb. 5, 2002

(54) FIGURE-LIKE TOY PROJECTILE AND LAUNCHING PLATFORM ASSEMBLY

(76) Inventor: Donald Spector, 380 Mountain Rd., Union City, NJ (US) 07080

( * ) Notice: Subject to any disclaimer, the term of this patent is extended or adjusted under 35 U.S.C. 154(b) by 700 days.

(21) Appl. No.: 08/709,764

(22) Filed: Sep. 9, 1996

(51) Int. Cl.[7] ..... A63H 11/06
(52) U.S. Cl. ..... 446/309; 446/308; 446/311
(58) Field of Search ..... 446/308, 309, 446/311, 430, 486, 489; 124/17, 26

(56) References Cited

U.S. PATENT DOCUMENTS

| | | | | | |
|---|---|---|---|---|---|
| 202,990 | A | * | 4/1878 | Chinnock | 446/311 |
| 773,692 | A | * | 11/1904 | Uhrig | 446/311 |
| 847,755 | A | * | 3/1907 | Flora | 446/311 |
| 3,108,395 | A | * | 10/1963 | Goldfarb | 446/311 |
| 3,210,885 | A | * | 10/1965 | Shih et al. | 446/225 |
| 3,286,392 | A | * | 11/1966 | Fortunato | 446/225 |
| 3,581,434 | A | * | 6/1971 | Fels | 446/309 |
| 3,769,955 | A | * | 11/1973 | Dugan et al. | 446/225 |
| 4,512,690 | A | * | 4/1985 | Johnson | 446/61 |
| 4,681,555 | A | * | 7/1987 | Natiw | 446/327 |

FOREIGN PATENT DOCUMENTS

| | | | | |
|---|---|---|---|---|
| FR | 1134620 | * | 4/1957 | 446/309 |
| IT | 449886 | * | 6/1950 | 446/430 |

* cited by examiner

*Primary Examiner*—Jacob K. Ackun, Jr.
*Assistant Examiner*—Urszula M Cegielnik

(57) ABSTRACT

A figure-like toy-projectile and launching platform assembly adapted to propel the figure into space by means of an elastic spring concealed in the figure. The figure whose head forms the nose of the projectile includes arms and legs extending from a torso joined to the head, and an elongated cavity in the torso whose front end is an opening in the crotch between the legs and whose rear end lies in an upper region in the torso in line with the head. Received in the cavity is an elastic spring in the form of a condom having a ring and a stretchable shank, the ring being mounted in the crotch opening. The normal length of the shank is such as to create a space between the end of the shank and the end of the cavity to allow for expansion of the shank. The platform is formed by a pad on which is anchored an elongated probe which when the figure is pushed down by a player onto the pad is then inserted through the crotch opening into the condom to stretch the shank to occupy the free space and thereby develop a latent force, whereby when the player releases the figure, the stretched shank then proceeds to resume its normal length and in doing so to produce a thrust force that propels the figure.

4 Claims, 2 Drawing Sheets

FIG. 1
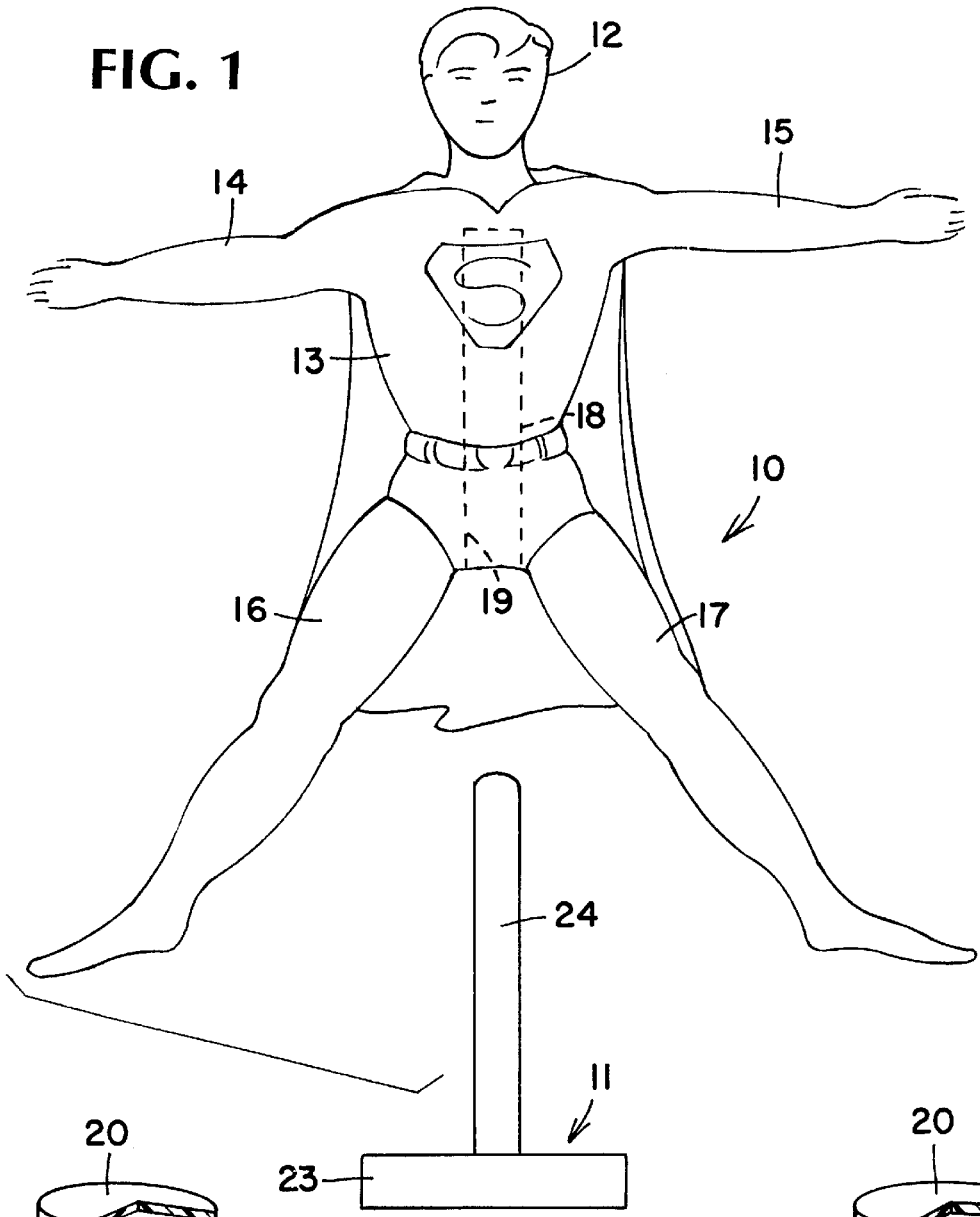
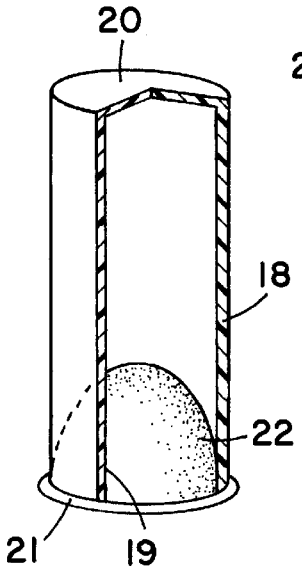
FIG. 2
FIG. 5
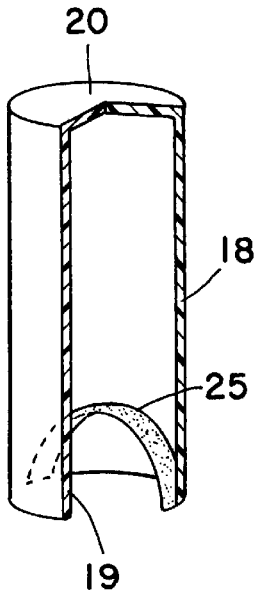

FIGURE-LIKE TOY PROJECTILE AND LAUNCHING PLATFORM ASSEMBLY

BACKGROUND OF THE INVENTION

1. Field of Invention:

This invention relates generally to toy projectiles propelled into space by an elastic spring; and more particularly to a figure-like toy projectile and launching platform assembly in which an elastic spring concealed in the figure is engaged by a probe extending from the platform and is stretched thereby to produce a thrust force to propel the figure into space.

2. Status of Prior Art:

A spring is an elastic member that regains its original shape after being extended or compressed. A stretchable elastic spring, such as a band of rubber, absorbs energy when it is stretched to develop a latent force. When the stretched band is released to resume its normal length, this produces a useable kinetic force.

Thus if a weight is attached to the rear end of an elastomeric line whose front end is attached to a ceiling so that the weight is then at a level well above the floor and the weight is then pulled down to the floor, when the weight is released, the stretched line, in resuming its normal length, will propel the weight toward the ceiling.

The use of a rubber band to propel a projectile is well-known. Thus a conventional slingshot makes use of a rubber band which bridges the tines of a fork whose handle is grasped by a player. By placing a pebble or other small projectile in a holder joined to the center of the band, and then pulling back the holder in which the pebble is held to stretch the band, the slingshot is then cocked in readiness to be fired. And when the holder is released, the stretched band, in resuming its normal length, then hurles the pebble into the air.

The greater the degree to which the slingshot band is stretched by the player, the greater is the thrust force applied to the pebble.

Similar spring-powered devices have heretofore been employed to propel toy figures into space. But the appeal of these toys to children is limited, for they fail to simulate the classic figure of Superman who appears to fly in space without any visible means of propulsion.

The concept of a superman is attributed to Nietzsche who in the 19th Century conceived of an "ubermensch" or "superman" free of the restraints imposed on ordinary humans. However, the Superman that is known universally to all children originated with the comic strip figure that first came into being in 1938. In recent years Superman appears as the hero in several highly popular motion pictures.

In the minds of children it is not Superman's superhuman strength that is his most marvelous characteristic, but his ability to leap into the air with his arms outstretched like wings and to fly at an incredible speed without a jet engine or other means of propulsion.

If therefore one wishes to create a toy figure-like projectile that flies in space like Superman, it is essential that this projectile be devoid of any visible means of propulsion.

If therefore the thrust force for a figure-like projectile is derived from-a stretchable spring, unless this spring and its operation are concealed, even should the figure resemble Superman in appearance, it will not impress a child as being authentic, for Superman's powers are derived from the remote planet where he was born and are invisible.

SUMMARY OF INVENTION

In view of the foregoing, the main object of this invention is to provide a toy figure-like projectile and a launching platform therefor to propel the figure into space in a manner emulating Superman.

A toy figure in accordance with the invention need not resemble Superman physically or in dress, for what the figure primarily emulates is the extraordinary ability to fly without any visible means of propulsion.

More particularly, an object of this invention is to provide a toy projectile and launching platform assembly of the above-type which, though spring-powered, in no way reveals the spring nor the manner in which it functions to apply a thrust force to the projectile.

Also an object of the invention is to provide an assembly of the above type which is safe to operate and which can be manufactured at low cost.

Briefly stated, these objects can be attained by a figure-like toy projectile and launching platform assembly adapted to propel the figure into space by means of an elastic spring concealed in the figure. The figure whose head forms the nose of the projectile includes arms and legs extending from a torso joined to the head, and an elongated cavity in the torso whose front end is an opening in the crotch between the legs and whose rear end lies in an upper region in the torso in line with the head. Received in the cavity is an elastic spring in the form of a condom having a ring and a stretchable shank, the ring being mounted in the crotch opening. The normal length of the shank is such as to create a space between the end of the shank and the end of the cavity to allow for expansion of the shank. The platform is formed by a pad on which is anchored an elongated probe which when the figure is pushed down by a player onto the pad is then inserted through the crotch opening into the condom to stretch the shank to occupy the free space and thereby develop a latent force, whereby when the player releases the figure, the stretched shank then proceeds to resume its normal length and in doing so to produce a thrust force that propels the figure.

BRIEF DESCRIPTION OF INVENTION

For a better understanding of the invention, as well as furhter object and features thereof, reference is made to the detailed description thereof to be read in conjunction with the accompanying drawings wherein:

FIG. 1 illustrates a toy figure-like projectile and launching platform assembly in accordance with the invention, as it appears prior to launching, the figure being separated from the platform;

FIG. 2 shows only the cavity in the torso of the figure and a stretchable spring in the form of a condom received in the cavity;

FIG. 5 shows another embodiment of a stretchable spring for propelling the figure.

DESCRIPTION OF INVENTION

Figure 3:
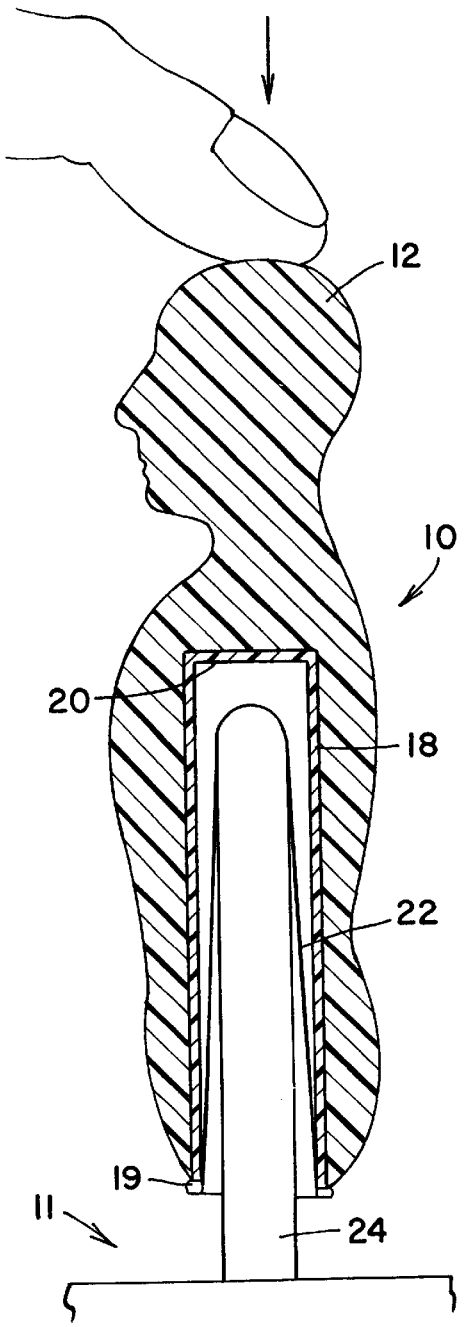
FIG. 3 shows the assembly in its cocked state, with the platform probe inserted in the condom to stretch it within the cavity to produce a latent force.

Referring now to FIG. 1, shown in this figure is an assembly in accordance with the invention whose main components are a toy projectile 10 in the shape of a small scale human or humanoid figure and a platform 11 from which the figure is propelled into space by a player who pushes the figure down onto the platform.

Projectile 10 which is preferably molded or otherwise formed of resilient foam plastic material, such as polyurethane or other soft material, such as a stuffed fabric-covered doll-like figure, includes a head 12 that forms the nose of the projectile.

Head 12 is joined by a neck to a torso 13 from whose upper or shoulder end extend an opposing pair of arms 14 and 15 terminating in hands. In practice, the arms may be outstretched in the manner of wings. Extending downwardly from the lower end of torso 13 is a pair of legs 16 and 17 terminating in feet.

Because FIG. 10 is propelled into space by a child, its structure must be free of any hard elements to avoid damage or injury should the figure strike a fragile object or person.

In practice, FIG. 10 may be formed, dressed and decorated to resemble the classic figure of Superman, for like Superman, this figure includes propulson means that are invisible.

Formed in the torso 13 of FIG. 10 is an elongated cavity 18 whose open front 19 is located at the crotch between legs 16 and 17 and whose closed rear end 20 is in the upper or chest region of torso 13 in alignment with head 10. In practice, cavity 18 may be formed by a cylindrical shell of rigid plastic material.

Received within cavity 18 is a short condom formed of latex or other elastomeric material, the condom being constituted by a ring 21 and a stretchable shank 22 extending from the ring. The ring 21 is securely mounted at crotch opening 19 of cavity 18. The normal length of shank 22 is such that its closed end falls short of the closed end 20 of the cavity to create a free space therebetween to allow for expansion of the shank.

Platform 11 is formed by a pad 23 which rests on the ground, a table or other playing surface, and an elongated probe 24 anchored on the pad and projecting upwardly therefrom. The diameter of probe 24 is somewhat smaller than the internal diameter of cavity 18.

Hence when, as shown in FIG. 3, a player pushes FIG. 10 down on platform 11 so that probe 24 then enters the condom and stretches its shank 22, shank 22 then fully occupies cavity 18. As a consequence of the energy absorbed by the shank, a latent force is developed.

Figure 4:
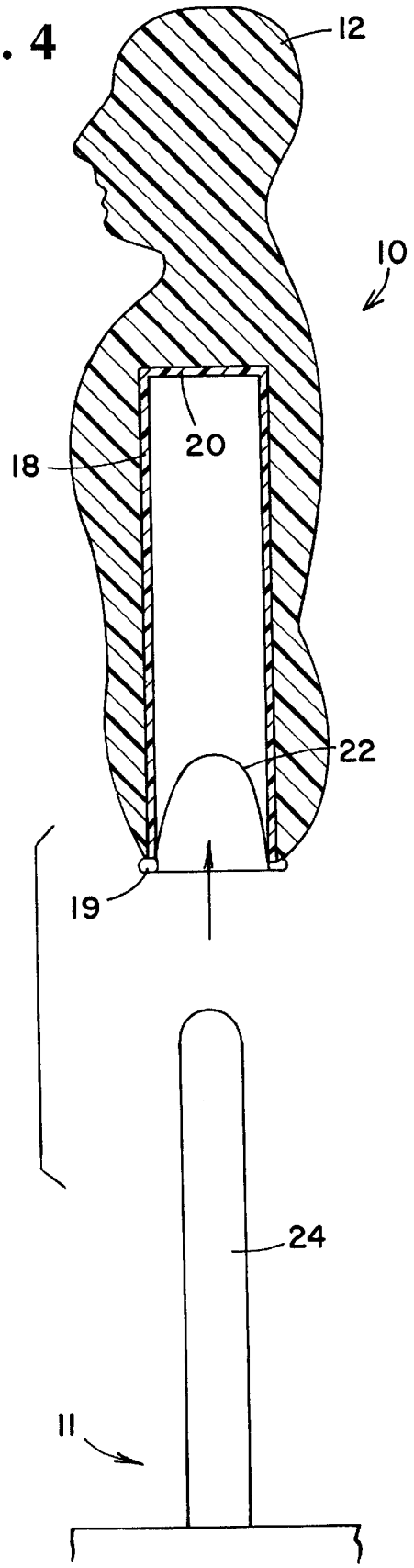
FIG. 4 shows the assembly in its fired state when the figure is released form the platform.

And when, as shown in FIG. 4, the player releases the figure, the stretched shank 22, when resuming its normal length, produces a strong thrust force that propels the figure into space. In practice, instead of a probe 24 that is anchored to project vertically above the pad, the pad may have a wedge shape to cause the probe to project at an acute angle whereby the figure, instead of being propelled upwardly into space, is propelled to fly in an angled projectory.

The elastic spring for propelling the figure need not be in condom form. Thus, as shown in FIG. 5, the elastic spring may take the form of band 25 of rubber or other elastic material whose ends are attached to diametrically opposed ends of the crotch opening 19 of the cavity 18.

Band 25 forms a "U" within cavity 18, the trough of the U being spaced from the closed end 20 of the cavity to allow for expansion when the probe 24 is inserted in the cavity to launch the figure into space.

Probe 24 is preferably of UHMW polyethylene or other material having a very low coefficient of sliding friction so that it does not frictionally engage the elastic spring.

Regardless of the nature of the elastic spring, it is concealed within cavity 18 and is not visible to the player or any observer. Hence when the player pushes the figure down on the platform and then releases it, the means by which the figure is propelled into space remains invisible and what causes the figure to fly like Superman is a mysterious force.

In practice, the elastic spring may be strong and short relative to the length of the elongated cavity in which it is received, so that if the child is able to fully stretch the spring within the cavity, the resultant thrust force when the figure is released, will propel the figure a long distance. And to cause the figure to travel head forward, a weight, such as lead pellets, may be embedded in head 10.

And instead of a human or humanoid figure, the figure may take a monster-like or fanciful form.

While there has been shown preferred embodiments of the figure-like toy projectile and launching platform assembly in accordance with the invention, it is to be understood that many changes may be made therein without departing from the spirit of the invention.

I claim:

1. A toy projectile and platform assembly comprising:

A. a projectile molded of resilient foam plastic material in the form of a figure having a head forming a nose of the projectile, a torso joined to the head, a pair of arms outstretched to resemble wings extending from an upper end of the torso, and a pair of legs extending from a lower end of the torso and a crotch therebetween;

B. an internal elongated cavity formed in the torso having an open front end at said crotch and a closed rear end in an upper region of the torso in line with the head;

C. an elastic spring received in the cavity having a normal length which is shorter than the length of the cavity to allow for expansion of the spring, said spring being formed by a condom having a a ring mounted at the front end of the cavity and a stretchable shank extending from the ring whose normal length is shorter than the length of the cavity; and D. a platform provided with a probe which when a player pushes the figure down on the platform then enters the front end of the cavity to engage and stretch the spring toward the rear end of the cavity and thereby develop a latent force which when the player releases the figure produces a thrust force as the spring resumes its normal length to propel the figure into space whereby the figure appears to be flying without any visible means of propulsion.

2. An assembly as set forth in claim 1, in which the platform includes a pad on which said probe is anchored.

3. An assembly as set forth in claim 1, in which the figure resembles Superman.

4. An assembly as set forth in claim 1, in which the cavity is formed by a cylindrical shell of rigid plastic material.

* * * * *